US005135009A

United States Patent [19]

Müller et al.

[11] Patent Number: 5,135,009

[45] Date of Patent: Aug. 4, 1992

[54] SMOKABLE ARTICLE

[75] Inventors: Bernd-Henrik Müller; Wolfgang Wiethaup; Guillermo Gerding, all of Hamburg; Bernhard Hauser, Schenefeld; Knut Möller, Hamburg; Gert Rudolph, Hamburg, all of Fed. Rep. of Germany

[73] Assignee: B.A.T. Cigarettenfabriken GmbH, Hamburg, Fed. Rep. of Germany

[21] Appl. No.: 490,891

[22] Filed: Mar. 9, 1990

[30] Foreign Application Priority Data

Mar. 13, 1989 [DE] Fed. Rep. of Germany ..... 3908161

[51] Int. Cl.[5] ..... A24D 1/00; A24D 1/02; A24D 1/18

[52] U.S. Cl. ..... 131/194; 131/196; 131/360; 131/361; 131/363; 131/364; 131/335

[58] Field of Search ..... 131/194, 196, 360, 361, 131/363, 364, 335

[56] References Cited

U.S. PATENT DOCUMENTS 3,683,936 8/1972 O'Neil .
4,474,191 10/1984 Steiner .

FOREIGN PATENT DOCUMENTS 0271036 6/1988 European Pat. Off. .
1432618 1/1964 Fed. Rep. of Germany .
1185887 3/1970 United Kingdom .

*Primary Examiner*—V. Millin
*Attorney, Agent, or Firm*—Armstrong, Nikaido, Marmelstein, Kubovcik & Murray

[57] ABSTRACT

The present invention relates to a smokable article which is intended to permit the smoker to avoid the condensates usually present in the smoke while retaining the taste experience familiar from conventional cigarettes; this is achieved in that a sheet-like carrier element coated with an aroma-carrying material and having a low thermal capacity is brought into direct thermal contact with a heat source comprising a hollow cylindrical combustion element having at least one passage therethrough wherein said passage is separate and distinct from the hollow portion; in the pauses between draws a cavity serves as collecting container or reservoir for the aromatic substances developed which can be inhaled in the next draw by the smoker.

17 Claims, 4 Drawing Sheets

SMOKABLE ARTICLE

BACKGROUND OF THE INVENTION

1. Field of the Invention

The invention relates to a smokable article comprising an aerosol generating zone which includes a combustions element which is formed as a hollow cylinder having at least one passage, and a carrier element for an aerosol precursor which is in thermal contact with the combustion element, a mouthpiece and a sheath for the aerosol generating zone and the mouthpiece.

2. Description of the Prior Art

The influence of condensates occurring in the smoke of burning cigarettes has been under investigation for some time. One aim of the cigarette industry is to reduce this influence by largely eliminating the condensates. The desire to achieve an unrestricted smoking experience is an important design aspect.

A smokable article with tobacco material and a combustion element via a conduit in thermal contact with an aroma capsule is known from European Patent Publication No. 271,036. If in this smokable article the combustion element is ignited the smoker can draw air in an axial direction through the smokable article in the usual manner via a mouthpiece and an air passage, the air being heated at the glowing combustion element and on passing through the porous aroma capsule and the tobacco material, dissolving out aromatic substances without thereby igniting the tobacco material.

The dissolved-out aromatic substances are intended to give the smoker a taste impression with which he is familiar from smoking conventional cigarettes.

However, the taste impression obtained is relatively low because the hot air which passes through the aroma capsule cools down relatively rapidly and is thus not able to dissolve adequate amounts of aromatic substances out of the aroma capsule. In addition, the granulate containing the aromatic substances and filling the aroma capsule is uniformly impregnated with the aromatic substances (precursor material). This does not however take account of the fact that the air temperature in the flow direction diminishes along the aroma capsule so that from the rear portion facing the mouthpiece the heat-activatable flavouring or aroma-forming substances are dissolved out only inadequately.

In addition, in the prior art the aerosol formation takes place in the relatively small volume of the aroma capsule. As a result, between the draws following each other in time only an extremely small aroma reservoir can form and be available for the next draw.

Since the aerosol formation in the known smokable article depends mainly on the supply of the hot air from the combustion element and air is a relatively poor heat conductor, finally a large amount of flavouring or aromatic carrier material is required to obtain an appreciable taste impression.

SUMMARY OF THE INVENTION

The problem underlying the present invention is therefore to provide a smokable article of the category specified in which the aforementioned advantages do not occur. In particular, a smokable article is to be proposed which enables the smoker to substantially avoid the undesired condensates whilst retaining the optimum enjoyment and in addition enables valuable flavouring and aroma-donating substances to be saved.

The invention therefore proposes in a smokable article comprising an aerosol generating zone having a combustion element which is formed as hollow cylinder having at least one passage, and a carrier element for an aerosol precursor which is in thermal contact with the combustion element, a mouthpiece and a sheath for the aerosol generating zone and the mouthpiece, the improvement that the carrier element for the aerosol precursor is a sheet-like structure which consists of material of low thermal capacity and high thermal conductivity, for example metal, and is at least partially coated with the flavouring or aroma-forming substances.

The advantages achieved with the invention are based substantially on the formation of the carrier element as a sheet-like structure which is made from a material of low heat capacity and high thermal conductivity. This material may in particular be a suitable metal, for example copper or aluminum. The carrier or substrate element is at least partially coated with aroma-forming substances, and the magnitude of the coated surface area should be between 300 and 1500 $mm^2$, preferably between 600 and 800 $mm^2$, because carrier elements of this order of magnitude have a particularly effective aroma yield.

To obtain the necessary surface area it is advantageous to impart to the substrate or carrier element, which may also consist for example of a normal sheet metal, a three-dimensional structure, thereby enabling the surface area of the carrier element to be increased without requiring appreciably more space. This can be done for example by folding or bending the carrier element, for example to a structure which is of star, serpentine or corrugated cross-section.

To obtain the advantages due to the thermal conditions, which can be achieved by the narrow contact between the carrier element and the combustion element, in the latter recesses should be provided which contact the carrier element. In the case for example where the carrier element is a simple metal plate, these recesses may consist of one or two slots along the inner surfaces of the combustion element into which the longitudinal sides of the combustion element are pressed.

The volume of the cavity into which the carrier element projects and which serves to form an aroma reservoir in which aroma can develop between two draws should not be smaller than 0.5 ml, preferably lying between 0.7 and 1.5 ml.

Since the carrier element can be very strongly heated it is advantageous to maintain between the carrier element and the inflammable mouthpiece a spacing of 30 to 50 mm. Such a spacing also has advantages as regards an optimum heat balance.

Since a heat gradient arises across the carrier element it is advantageous to adapt the temperature-dependent volatility of the flavouring or aroma-forming substances to said temperature gradient. Accordingly, in the vicinity of the combustion element the precursor materials disposed on the carrier element should be less volatile whereas they are considerably more volatile further from the combustion element towards the mouthpiece side.

If the heat gradient is large enough it may be advantageous to improve the mechanical stability of the overall arrangement to support or secure the carrier element at the cavity wall and/or at the mouthpiece.

A combustion element formed as hollow body offers as regards its combustion and/or flavour-influencing effect the most extensive advantages if in addition to the combustible material preferably made from pyrolized plant material other additives have been added thereto consisting of binding agents and/or combustion-influencing and/or flavour-influencing agents.

To ensure on the one hand an advantageous heat balance and on the other hand prevent parts of the smokable article being unintentionally ignited, it is advantageous to provide at least in the region of the combustion element an insulating layer surrounding the combustion element.

To ensure that the precursor material covering the surface of the substrate or carrier element adheres particularly well to the surface thereof it is advantageous to treat the surface of the carrier element chemically and/or mechanically. Such a treatment may for example consist of roughening the surface or also reducing the surface tension of the carrier element material.

A particularly good application and aroma development can be obtained if the aerosol precursor consists of a combination of tobacco extracts, aromatic substances, water, glycerol, higher valency alcohols, sugar and thickeners and adhesives, a pectin content of about 5% being preferred. Said pectin content guarantees a particularly good coating and bonding behaviour on application to the carrier element.

To enable aromatic substances to be stored within the hollow body in the pauses between draws it is advantageous to make the wall of the hollow body from material which has a low air permeability or is even air-impermeable. Possible materials for the wall of the hollow body apart from cigarette paper of low porosity are cardboard or plastic.

In addition, for the wall material, combinations can also be used wound and/or bonded entirely or partially from tobacco material. A further possibility is to use a tube extruded from tobacco material.

It may of course also be advantageous to use combinations of the aforementioned wall materials. Both the air permeability and the aroma properties of the tobacco material can be advantageously influenced by casing.

Apart from the possibility of forming the mouthpiece as filter, it may also be advantageous as regards the aerosol formation to form the mouthpiece as tobacco plug or as a combination of filter and tobacco plug.

To impart the necessary mechanical strength to the smokable article, which consists essentially of the hollow body wall of the insulating layer with the enclosed combustion element and mouthpiece, it is advantageous to connect the components enumerated by at least one sheath, which may in particular be a cigarette paper.

BRIEF DESCRIPTION OF THE DRAWINGS

The invention will be explained in detail hereinafter with reference to examples of embodiment with the aid of the attached schematic drawings, wherein:

FIG. 1*a* shows a fundamental arrangement of the smokable article in longitudinal section with central attachment of the substrate or carrier element, FIGS. 1*b* and 1*c* shows an ignition-side plan view of a smokable article and the inserted combustion element in a perspective view, FIGS. 1*a* and 1*e* shows an ignition-side plan view of a smokable article into which a combustion element of star-shaped cross-section is inserted, and the star-shaped combustion element in a perspective view.

DETAILED DESCRIPTION OF THE PREFERRED EMBODIMENTS

Figures 1A, 1B, 1C, 1D, 1E:
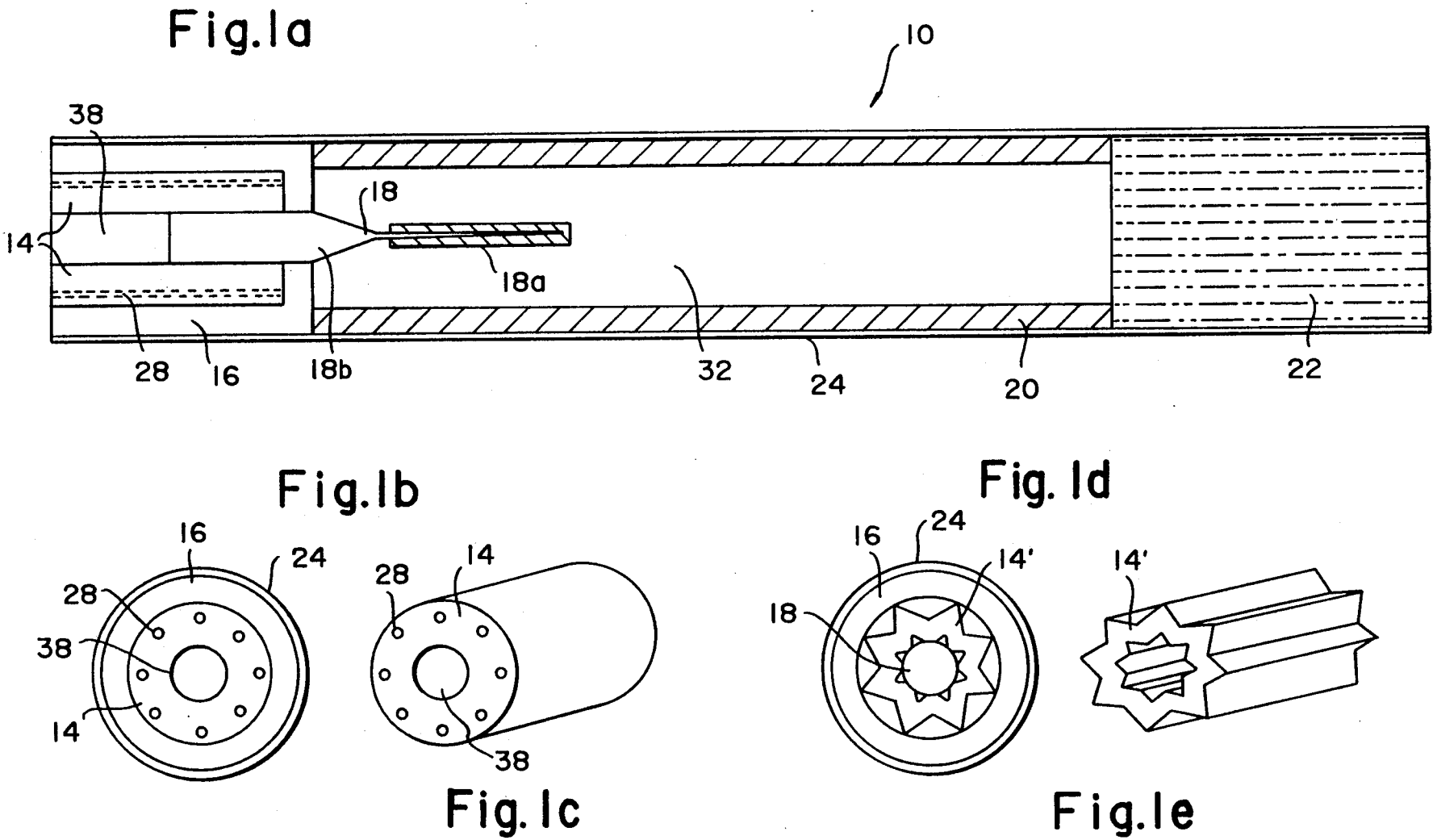

In FIG. 1*a* a smokable article is illustrated which is denoted here generally by the reference numeral 10 and comprises a hollow cylindrical combustion element 14 with ventilating passage 28, an insulating layer 16, a substrate or carrier element 1*a* including the parts 18 and 18*b*, a hollow body 32 with its wall 20 and a filter 22.

In the embodiment according to FIGS. 1*a* and 1*b* the insulating layer 16 surrounds the combustion element on the mouth side and must accordingly be air-permeable. The insulating layer 16 may also be formed as a hollow cylinder or as 1 fleece layer without covering of the mouth-side end face of the combustion element.

The portion 18*a* denotes the region of the carrier element 18 which is preferably coated with precursor material and which projects into the hollow body 32 whilst the portion 18*b* implements the thermal-mechanical fit in or round the combustion element 14.

The projecting portions are mechanically connected together by the sheath 24. The region 18*a* of the carrier element 18 is predominantly coated with precursor material. The carrier element 18 is moreover held with its portion 18*b* centrally in the internal diameter of the heating element.

FIGS. 1*b* and 1*c* shows the ignition-side plan view of the smokable article according to FIG. 1*a* as well as a perspective view of the hollow cylindrical combustion element 14 used in this case. On the outside the sheath 24 can be seen. This is then followed towards the center by the insulating layer 16 and the hollow cylindrical combustion element 14 which is provided with air passages 28. For the purpose of thermal contact the carrier element 18 (not shown here) is inserted into the central inner passage of the hollow cylindrical combustion element. The surface of the internal central diameter may be provided with the holding means for example slots.

FIGS. 1*d* and 1*e* shows a plan view comparable to that of FIG. 1*b* with the difference that in the arrangement according to this Figure a combustion element 14' of the star-shaped cross-section is used. In this case the ignition-side end of an embodiment of the carrier element 18 can be seen. Air passages are not necessary when using combustion element 14' of star-shaped cross-section because the air can pass through the intermediate spaces between the combustion element and insulating layer 16 as well as between the combustion element 14' and carrier element 18.

If the smokable article 10 is now ignited at its combustion element 14, by the direct thermal contact between the combustion element 14 and the carrier element 18 heat is transferred to the precursor material applied in the region 18*a* to the carrier element and stimulates the aerosol formation.

If the smoker now draws on the mouthpiece 22 he sucks up the aromatic substances via said mouthpiece. In addition, hot air which has already flown through the combustion element is led up to the carrier element 18 and thus to the region 18*a* of said carrier element 18 coated with precursor material. As a result additional aromatic substances are volatilized and available to the smoker for inhalation. In the intervals between draws when the portion of the carrier element 18*a* not coated with precursor material is not flushed with hot air heat is nevertheless supplied to the precursor by the direct thermal contact between the combustion element 14 and the carrier element 18. As a result, in the pauses between draws as well aromatic substances are liberated from the precursor and collect in the hollow body 32 because they can hardly escape of not escape at all through the cavity wall 20. On the next draw of the smoker they are available to him for full enjoyment.

Figure 2A:
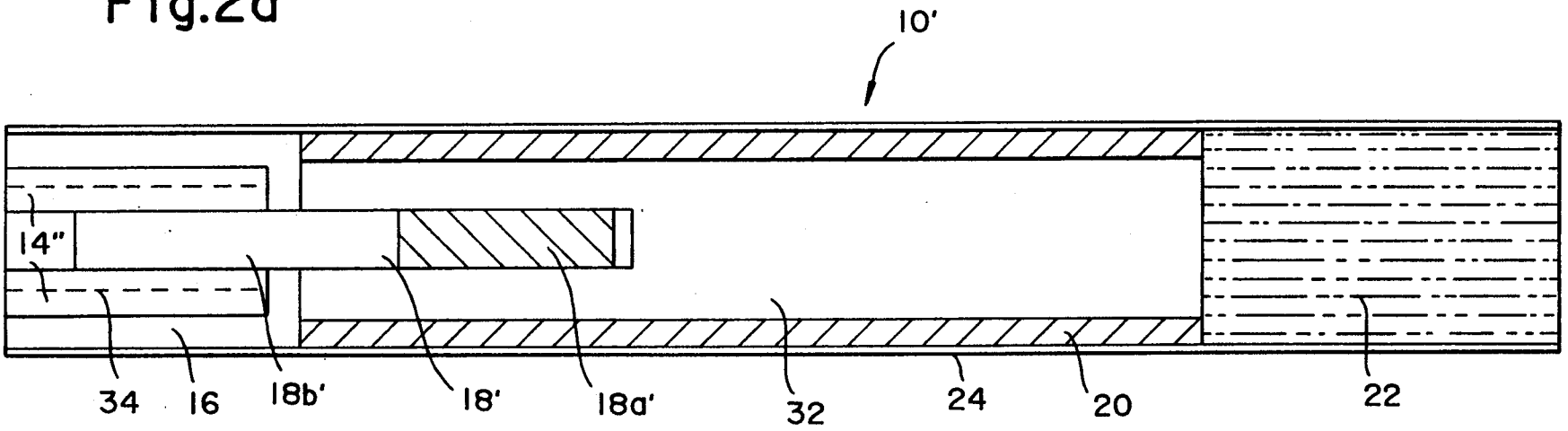
FIG. 2*a* shows a further preferred embodiment of the smokable article in longitudinal section.
Figure 2B:
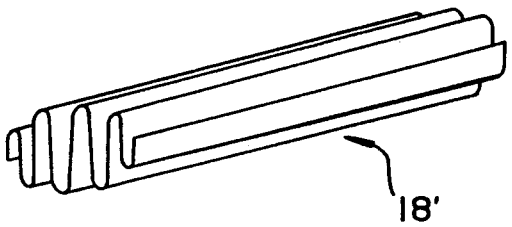
FIG. 2*b* shows a corrugated carrier element.

In the embodiment 10' illustrated in FIG. 2*a* a carrier element 18' with its uncoated region is partially inserted into the combustion element 14'' of star-shaped cross-section. FIG. 2*b* shows the perspective view 18*b'* of the carrier element 18' illustrated in cross-section.

Figure 2C:
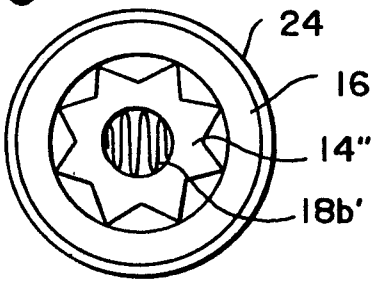
FIG. 2*c* shows an ignition-side plan view of a smokable article having a combustion element of start-shaped cross-section and a correspondingly adapted corrugated carrier element.

FIG. 2*c* shows the ignition-side plan view of the smokable article 10' illustrated in FIG. 2*a*. Within the inner circular diameter of the otherwise star-shaped combustion element 14'' the portion 18*b'* of the carrier element 18' not coated with precursor material can clearly be seen.

If with the arrangement 10' the smoker draws at the mouthpiece 22 after the combustion element 14'' of the smokable article 10' has been ignited, the heated air is sucked through the inner central passage of the combustion element 14'' and flows through the carrier element 18' coated with precursor material. Thereafter, it passes via the hollow body 32 and through the mouthpiece 22 into the inhalate inspired by the smoker.

Figure 3A:
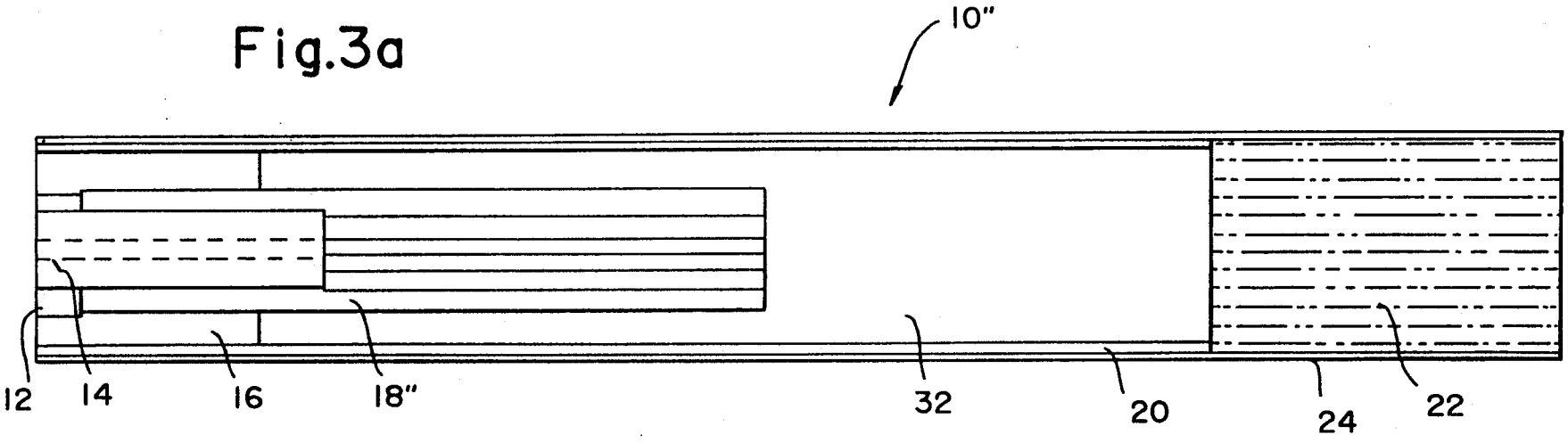
FIG. 3*a* shows a smokable article in longitudinal section which is provided with a carrier element of star-shaped cross-section.

In the embodiment according to FIG. 3*a* the smokable article 10'' is provided with a cylindrical combustion element 14 which is largely surrounded by a carrier element formed star-shaped in cross-section. The hollow cylindrical insulating layer 16 and the hollow cylindrical insulating layer 12 form mechanical holding means for the combustion element 14 and the carrier element 18''. If the insulating layer 16 has adequate stability the insulating layer 12 can be omitted.

Figure 3B:
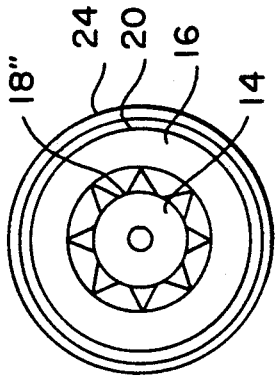
FIG. 3*b* is an ignition-side plan view of the smokable article with a carrier element of star-shaped cross-section.

FIG. 3*b* shows the ignition-side plan view of the smokable article according to FIG. 3*a* without insulating layer 12 with corresponding cutout.

In the examples of embodiments 10, 10', and 10'' are shown the combustion elements 14, 14', 14'' which are made in the form of a carbon compact and it can be seen that the cross-sectional area of the combustion element can assume not only the form of a pure hollow cylinder but also a star-shaped cross-section and other cross-sectional forms. The combustion element 14, 14', 14'' comprises in the embodiments illustrated a body having an external diameter which is between 5 and 8 mm and an internal diameter which is between 1 and 4.5 mm. The length of the combustion element 10 may be between 10 and 20 mm.

The carrier element 18, 18', 18'', which is a sheet-like object of material of low thermal capacity, in particular metal, should have an effective area coated with aerosol precursor which is not less than 300 $mm^2$ and not greater than 1500 $mm^2$, the examples 10, 10', 10'' of embodiment illustrated being based on the particularly favourable effective area of 600 to 800 $mm^2$.

The regions 18*a*, 18*a'* of the carrier element 18, 18' are coated with precursor material of a combination of tobacco extracts, aromatic substances, water, glycerol, higher valency alcohols, sugar and thickeners and adhesives, about 5% pectin being added to the precursor material. The regions 18*a*, 18*a'* of the carrier elements 18, 18' may be coated with aerosol precursor also in a hot state.

The cavity 32 with its wall 20 serves as reservoir for the aerosol formed in the draw intervals and has an empty volume which is greater than 0.5 ml. The empty volume should be between 0.7 and 1.5 ml.

Between the mouthpiece-side end of the carrier element 18, 18', 18'' and the mouthpiece-side end of the smokable article 19, 10', 10'', a distance of about 30 to 50 mm is maintained.

The hollow body 32 has a total length of 30 to 50 mm and the mouthpiece a total length of about 15 to 30 mm. The total length of the smokable article 10, 10', 10'' consequently lies between 55 and 100 mm whilst its external diameter lies between 7 and 10 mm. In specific cases the carrier element 18, 18', 18'' is secured or supported at the wall 20 of the cavity 22 and/or at the mouthpiece 22.

FIGS. 4*a* to 4*f* show various configurations of the sheet-like carrier element 18, 18', 18'', to which a three-dimensional shape has been imparted by controlled deformation.

Figure 4B:
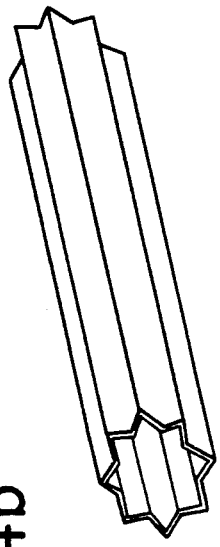
FIG. 4*b* shows a carrier element of star-shaped cross-section.
Figure 4D:
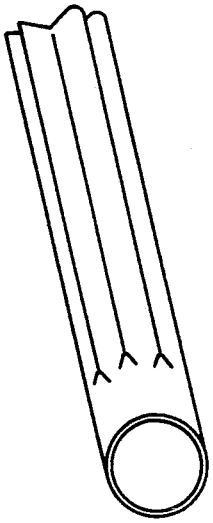
FIG. 4*d* shows a carrier element which on the ignition side is adapted in its external diameter to the internal diameter of the combustion element and is folded towards the mouthpiece.
Figure 4F:
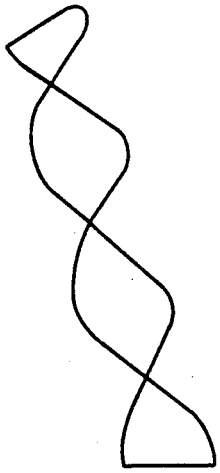
FIG. 4*e* shows a carrier element which is represented on the ignition side as planar metal sheet and towards the mouthpiece merges into a partial cylinder and FIG. 4*f* shows a helically drawn carrier element.
Figure 4A:
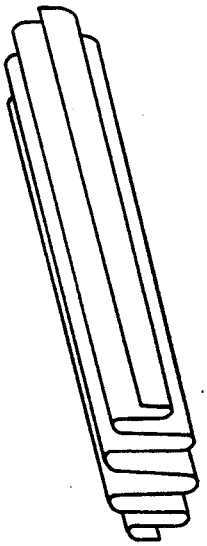
FIG. 4*a* shows a carrier element corrugated in the transverse direction.

FIG. 4*a* shows a form which is corrugated in cross-section, the envelopes being adapted in cross-section to the form of the inner passage of the combustion element 14, 14', 14'' in such a manner that an interference or pressure fit results.

FIG. 4*b* shows a configuration of star-shaped cross-section for the carrier element 18, 18', 18''. The embodiment according to FIG. 4*b* may be adapted both with the teeth on the outside of the cross-section to the internal diameter of the combustion element 14, 14', 14'' which surrounds the carrier element and with the teeth on the inside in the cross-section to the external diameter of a combustion element 14 surrounded by the carrier element 18'' (see FIG. 3*a*).

Figure 4C:
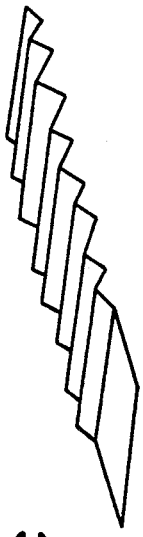
FIG. 4*c* shows a carrier element with equidistant bends in the longitudinal direction.

FIG. 4*c* shows a linearly continued carried element 18 with equidistant bends.

In the embodiment illustrated in FIG. 4*d* a funnel-shaped carrier element 18, 18', 18'' is bent on its linearly widening side in such a manner that the envelopes of the cross-section are circular.

Figure 4E:
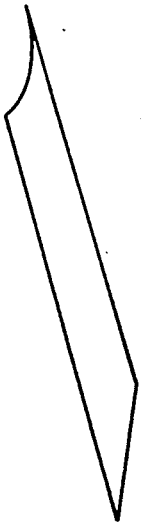

The carrier element 18 which can be seen in FIG. 4*e* could for example be cut from a trapezoidal metal sheet which is bent towards the wider end of the carrier element 18 in such a manner that its width remains constant.

Finally, FIG. 4*f* shows a helically bent carrier element.

We claim:

1. A smokable article having an aerosol generating zone, comprising:

a hollow cylindrical combustion element having at least one passage therethrough, said passage being separate and distinct from said hollow portions;

a carrier element for carrying an aerosol precursor, said carrier element being in thermal contact with said combustion element;

a support means for supporting said combustion element and said carrier element, and for containing the aerosol generating zone;

a mouthpiece connected to said support means; and sheath surrounding said support means at least in the vicinity of said aerosol generating zone and said mouthpiece; said carrier element for carrying said aerosol precursor being a sheet-like structure composed of material having a low thermal capacity and a high thermal conductivity, and said carrier element being at least partially coated with an aroma-forming substance; wherein the carrier element is at least partially inserted into at least one correspondingly formed recess in the combustion element, and wherein a cavity into which the carrier element projects has a length of 30 to 50 mm.

2. A smokable article according to claim 1, wherein the sheet-like structure is deformed to a three-dimensional structure, thereby enlarging its surface area.

3. A smokable article according to claim 1, wherein the carrier element has a surface coated with aerosol precursor having a magnitude between 300 and 1500 $mm^2$, preferably between 600 and 800 $mm^2$.

4. A smokable article according to claim 1, wherein said aerosol precursor is applied directly to said carrier element.

5. A smokable article according 10 claim 1, wherein the surface of said carrier element is prepared for an adhesive so as to enhance its adhesive power by at least one of a chemical treatment and a mechanical treatment.

6. A smokable article according to claim 1, wherein said support means comprises a hollow body having a wall which has a low air permeability.

7. A smokable article according to claim 1, wherein said carrier element includes a portion which is surrounded by a cavity formed by said support means and a portion which is received within said combustion element, wherein said combustion element is composed of a tube of tobacco material.

8. A smokable article according to claim 7, wherein said cavity, said combustion element surrounded by said insulating layer and said mouthpiece are connected by said sheath.

9. A smokable article according to claim 7, wherein said carrier element extends over the entire cavity and is connected to said mouthpiece.

10. A smokable article according to claim 1, wherein said combustion element includes at least one of additives of binding agents, combustion-influencing agents, and flavor-influencing agents.

11. A smokable article according to claim 1, wherein the combustion element is surrounded by an insulating layer.

12. A smokable article according to claim 1, wherein the mouthpiece is formed as filter and/or tobacco plug.

13. A smokable article having an aerosol generating zone, comprising:

a hollow cylindrical combustion element having at least one passage therethrough, said passage being separate and distinct from said hollow positions;

a carrier element for carrying an aerosol precursor, said carrier element being in thermal contact with said combustion element;

a support means for supporting said combustion element and said carrier element, and for containing the aerosol generating zone;

a mouthpiece connected to said support means; and a sheath surrounding said support means at least in the vicinity of said aerosol generating zone and said mouthpiece; said carrier element for carrying said aerosol precursor being a sheet-like structure composed of material having a low thermal capacity and a high thermal conductivity, and said carrier element being at least partially coated with an aroma-forming substance; and wherein said aerosol precursor with which said carrier element is coated comprises a combination of tobacco extracts, aromatic substances, water, glycerol, higher valency alcohols and thickeners and adhesives which in particular have a pectin content of about 4 to 6%.

14. A smokable article having an aerosol generating zone, comprising:

a hollow cylindrical combustion element having at least one passage therethrough, said passage being separate and distinct from said hollow portions;

a carrier element for carrying an aerosol precursor, said carrier element being in thermal contact with said combustion element;

a support means for supporting said combustion element and said carrier element, and for containing the aerosol generating zone;

a mouthpiece connected to said support means; and a sheath surrounding said support means at least in the vicinity of said aerosol generating zone and said mouthpiece; said carrier element for carrying said aerosol precursor being a sheet-like structure composed of material having a low thermal capacity and a high thermal conductivity, and said carrier element being at least partially coated with an aroma-forming substance; wherein said carrier element includes a portion which is surrounded by a cavity formed by said support means and a portion which is received within said combustion element, wherein the wall of said cavity is composed of a tube of tobacco material, and wherein the empty volume of the cavity is not less than 0.5 ml and is preferably between 0.7 and 1.5 ml.

15. A smokable article having an aerosol generating zone, comprising:

a hollow cylindrical combustion element having at least one passage therethrough, said passage being separate and distinct from said hollow portions;

a carrier element for carrying an aerosol precursor, said carrier element being in thermal contact with said combustion element;

a support means for supporting said combustion element and said carrier element, and for containing the aerosol generating zone;

a mouthpiece connected to said support means; and a sheath surrounding said support means at least in the vicinity of said aerosol generating zone and said mouthpiece; said carrier element for carrying said aerosol precursor being a sheet-like structure composed of material having a low thermal capacity and a high thermal conductivity, and said carrier element being at least partially coated with an aroma-forming substance; and wherein the spacing between the carrier element and the mouthpiece is 30 to 50 mm.

16. A smokable article having an aerosol generating zone, comprising:

a hollow cylindrical combustion element having at least one passage therethrough, said passage being separate and distinct from said hollow portions;

a carrier element for carrying an aerosol precursor, said carrier element being in thermal contact with said combustion element;

a support means for supporting said combustion element and said carrier element, and for containing the aerosol generating zone;

a mouthpiece connected to said support means, and a sheath surrounding said support means at least in the vicinity of said aerosol generating zone and said mouthpiece; said carrier element for carrying said aerosol precursor being a sheet-like structure composed of material having a low thermal capacity and a high thermal conductivity, and said carrier element being at least partially coated with an aroma-forming substance; and wherein said precursor material contains on the mouth side increasingly more volatile substances.

17. A smokable article having an aerosol generating zone, comprising:

a combustion element;

a carrier element for carrying an aerosol precursor, said carrier element being in thermal contact with said combustion element;

a support means for supporting said combustion element and said carrier element, and for containing the aerosol generating zone;

a mouthpiece connected to said support means; and a sheath surrounding said support means at least in the vicinity of said aerosol generating zone and said mouthpiece; said carrier element for carrying said aerosol precursor being composed of material having a low thermal capacity and a high thermal conductivity, and said carrier element being at least partially coated with at least one of a heat-activatable flavor-forming substance and a heat-activatable aroma-forming substance.

* * * * *